US010144554B2

(12) United States Patent
Cui

(10) Patent No.: US 10,144,554 B2
(45) Date of Patent: Dec. 4, 2018

(54) PROTECTIVE SLIDER ZIPPER

(71) Applicant: TAKEBISHI (DALIAN) INDUSTRIAL CO., LTD., Dalian (CN)

(72) Inventor: Jiasheng Cui, Dalian (CN)

(73) Assignee: Takebishi (Dalian) Industrial Co., LTD, Dalian (CN)

( * ) Notice: Subject to any disclaimer, the term of this patent is extended or adjusted under 35 U.S.C. 154(b) by 0 days.

(21) Appl. No.: 15/026,963

(22) PCT Filed: May 8, 2015

(86) PCT No.: PCT/CN2015/078519
§ 371 (c)(1),
(2) Date: Apr. 2, 2016

(87) PCT Pub. No.: WO2016/172995
PCT Pub. Date: Nov. 3, 2016

(65) Prior Publication Data

US 2018/0057219 A1 Mar. 1, 2018

(30) Foreign Application Priority Data

Apr. 30, 2015 (CN) ..... 2015 1 0215614

(51) Int. Cl.
*A44B 19/26* (2006.01)
*B65D 33/25* (2006.01)
*B65B 61/18* (2006.01)

(52) U.S. Cl.
CPC ..... *B65D 33/2591* (2013.01); *B65B 61/188* (2013.01); *B65D 33/25* (2013.01); *Y10T 24/2534* (2015.01); *Y10T 24/2561* (2015.01); *Y10T 24/2582* (2015.01)

(58) Field of Classification Search
CPC ..... Y10T 24/2561; Y10T 24/2564; Y10T 24/2582; A44B 19/16; A44B 19/267; A44B 19/265; A44B 19/19265
See application file for complete search history.

(56) References Cited

U.S. PATENT DOCUMENTS

| | | | | |
|---|---|---|---|---|
| 5,871,281 | A * | 2/1999 | Stolmeier | B65D 33/2591 24/417 |
| 6,789,947 | B1 * | 9/2004 | Kasai | B65D 33/2591 24/400 |
| 9,505,531 | B2 * | 11/2016 | Chapek | B65D 50/00 |
| 2006/0168779 | A1 * | 8/2006 | Chaturvedi | B65D 33/2591 24/415 |
| 2016/0338454 | A1 * | 11/2016 | Chapek | B65D 50/00 |

* cited by examiner

*Primary Examiner* — Robert Sandy
*Assistant Examiner* — Michael S Lee
(74) *Attorney, Agent, or Firm* — Inventa Capital PLC

(57) ABSTRACT

A protective slider zipper, comprising a zipper and a slider for opening and closing the zipper, wherein an upper part of the slider is in a protection structure; the root part of the protection structure is in a bending structure capable of being repeatedly bent; a first work support surface at one side of the protection structure is fixedly connected with a first slider hand; the zipper comprises a female strip and a male strip; and the female strip is connected with and separated from the male strip through the slider.

13 Claims, 8 Drawing Sheets

PROTECTIVE SLIDER ZIPPER

RELATED APPLICATION

This is the U.S. national phase application of International Application PCT/CN2015/078519, with an international filing date of May 8, 2015. The present application claims the benefit of the Chinese Patent Application CN2015102156146 filed Apr. 30, 2015, which is incorporated herein by reference in its entirety.

FIELD OF THE INVENTION

The invention relates to the technical fields of structural design and application of zippers, and particularly provides a proactive slider zipper.

BACKGROUND OF THE INVENTION

Plastic packing bags are widely applied to food storage and many other areas in daily life. While the application of an opening-closing strip provides convenience for plastic bags which are cyclically opened, the invention of the slider zipper enables the opening-closing strip to open and close more easily. The opening-closing strip comprises two side strips which are respectively located at two ends of each plastic bag for closing the plastic bag.

Diverse foods can be stored in the plastic bags. Some stored goods include packaged goods, such as granules and power. These packaged goods may include sugar, salt, baby milk, coffee, cookies and the like. When these goods are poured out, the situation that the zipper cannot be closed due to residues frequently occurs; with the residues, the side strips at the two ends of the zipper cannot be closed together; as a result, the zipper cannot be closed.

Currently speaking, the packing bag with the slider zipper is only provided with the slider zipper at the unsealed part; such structure is very poor in air-tightness on the bag body, and the goods in the bag body are easily affected with damp or are polluted by other factors, so that the substances in the bag body go bad. No protective device is provided for the slider and the zipper, and if the packing bag is applied to chemical industry, medicines, healthcare products and other granules, powder and solid mixtures, as well as the products which children are prohibited to eat or touch in the absence of adult supervision, the food poisoning in children is easily incurred.

People are eager to obtain the protective slider zipper with excellent technical effects.

OBJECT AND SUMMARY OF THE INVENTION

The invention aims at providing the protective slider zipper, which can prevent the condition that the zipper cannot be closed doe to the fact that the residues are left on the zipper when the goods are poured out, and can prevent the children from eating or touching a toxic product in the absence of adult supervision.

A protective slider zipper, which comprises a zipper (2) and a slider (1) for opening and closing the zipper (2), wherein the upper part of the slider (1) is in a protection structure (19); the root part of the protection structure (19) is in a bending structure (7) capable of being repeatedly bent; a first work support surface (14) at one side of the protection structure (19) is fixedly connected with a first slider hand (11); the zipper (2) comprises a female strip (3) and a male strip (4); and the female strip (3) is connected with and separated from the male strip (4) through the slider (1).

The protective slider zipper, which comprises the zipper (2) and the slider (1) for opening and closing the zipper (2), wherein the protection structure (19) is connected with the slider (1) through a rotating shaft (8); the first work support surface (14) at one side of the protection structure (19) is fixedly connected with the first slider hand (11); the zipper (2) comprises the female strip (3) and the male strip (4); and the female strip (3) is connected with and separated from the male strip (4) through the slider (1).

The female strip (3) is connected to a first side surface (5); and the male strip (4) is connected to a second side surface (6).

A second work support surface (9) and a work positioning step (18) for fixing the protection structure (19) are arranged at one end of the slider )1); a second slider hand (12) is arranged at the inner side of the lower part of the second work support surface (9); a second protection support surface (17) and a protection positioning step (16) for fixing the protection structure (19) are arranged at the other end of the slider (1); the protection structure (19) is pushed back and forth by hands; when a first protection support surface (10) at one side of the protection structure (19) contacts the second protection support surface (17) on the slide block, the protection positioning step (16) fixes the protection structure (19) on the second protection support surface (17), and prevents the protection structure (19) from loosening to play a positioning role, and the slider (1) is in a protected state; and when the first work support surface (14) at one side of the protection structure (19) contacts the second work support surface (9) on the slider (1), the work positioning step (18) fixes the protection structure (19) on the second work support surface (9), and prevents the protection structure (19) from loosening to play a positioning role, and the slider (1) is in a working state.

The second slider hand 12 penetrates into a first outline for clearing the residues in the male strip (4) when the zipper is closed from top to bottom in general.

An aileron (20) is arranged at the upper part of each of the female strip (3) and the male strip (4); and the two ailerons (20) are fastened to each other to prevent dust from entering when the zipper (2) is locked.

The protection structure (19) connected with the slider (1) through the bending structure (7) or the rotating shaft (8).

A slider groove (13) is formed in one end of the zipper (2); the slider (1) is moved to the slider groove (13); the protection structure (19) is pushed to the second work support surface (9); the slider (1) is in a working state; and the first slider hand (11) enters the slider groove (13) and is lightly pulled towards the other end of the zipper (2), so that the bag can be opened.

A reinforcing rib (15) is arranged at the open part of the zipper (2) to prevent other substances from entering when the zipper (2) is at the opening.

The top end of the protection structure (19) is higher than two ends of the slider (1) when fastened to the second work support surface (9) and the second protection support surface (17) on the slider (1).

The protective slider zipper meets the requirements of consumers on safety of children, and is simple and convenient to operate. The protective slider zipper can be easily opened by a simple action of 'wrenching, pressing and pulling'. The protective slider zipper is very easy to open for adults and old people, hut is very challenging for children with the ages of five or below.

The protective slider zipper is applicable to the plastic packing bag which can be cyclically opened, and particularly is applicable to a slider zipper device which improves the opening-closing strip or the zipper applied to the plastic bag and can be prevented from being opened by children. The protective slider zipper can be ideally applied to packages of any products, including home nursing, chemical industry, medicines, healthcare products and enter granules, powder and solid mixtures, as well as the products which children are prohibited to eat or touch in the absence of adult supervision. A flexible package with the protective slider zipper is also applicable to the packages of medicinal cannabis foods due to the facts that the medicinal cannabis foods need to be prevented from being touched by children, and meanwhile, the shelf life needs to be prolonged as much as possible.

The protective slider zipper can be easily opened by adults, but cannot be opened by children at random, meets the requirements on safety of children, simultaneously can prolong the shelf life and has relatively great economic value and the social value.

Figure 1:
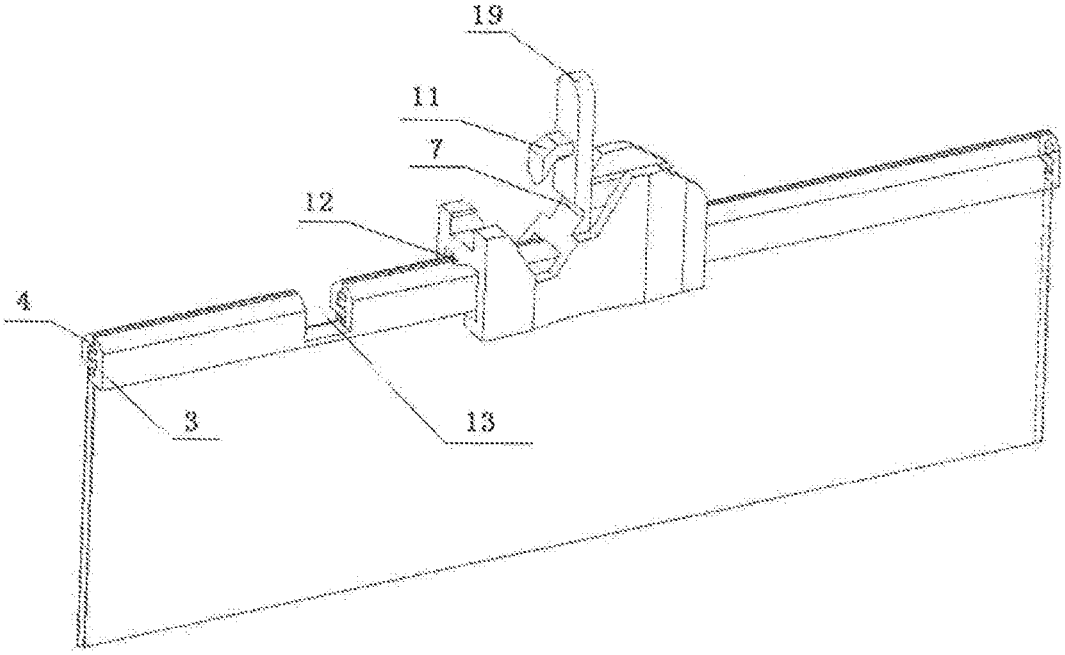
FIG. 1 is the application diagram of the protective slider zipper on the bag.
Figure 2:
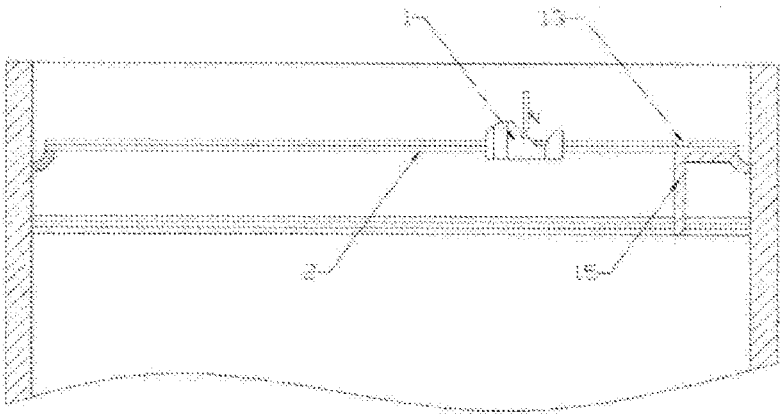
FIG. 2 is the application diagram of the protective slider zipper on the bag.
Figure 3:
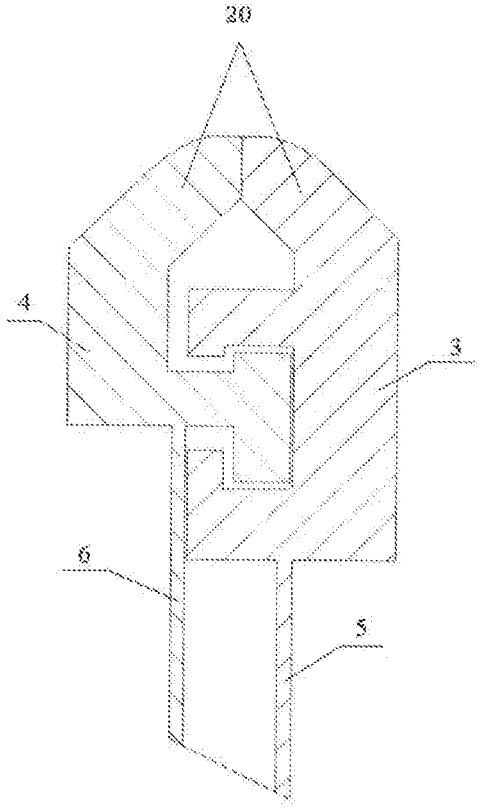
FIG. 3 is the diagram of locking of the male strip and the female strip.
Figure 4:
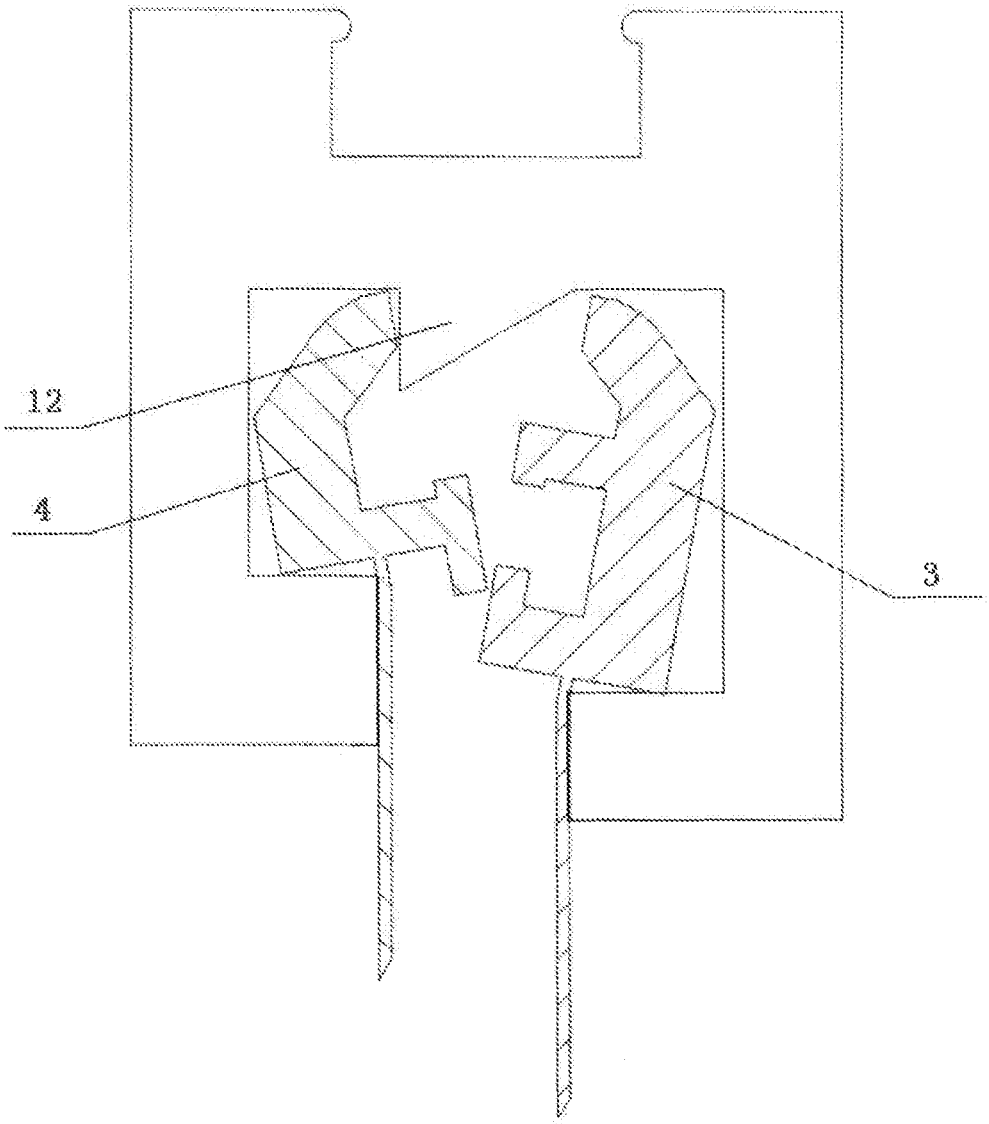
FIG. 4 is the application diagram of the second slider hand on the zipper in the open state.
Figure 5:
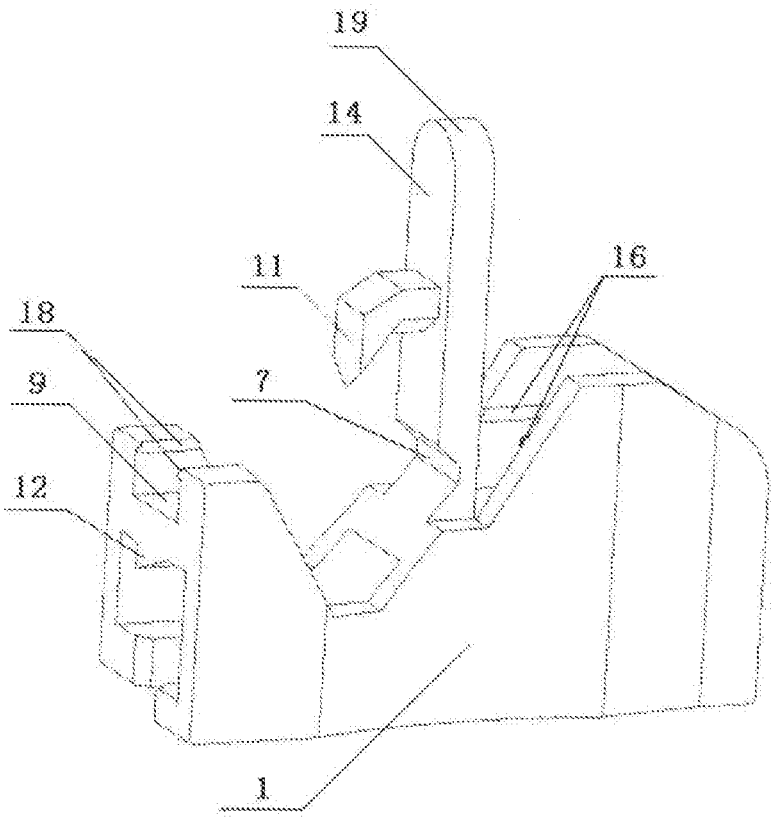
FIG. 5 is the diagram of she slider with the bending structure.
Figure 6:
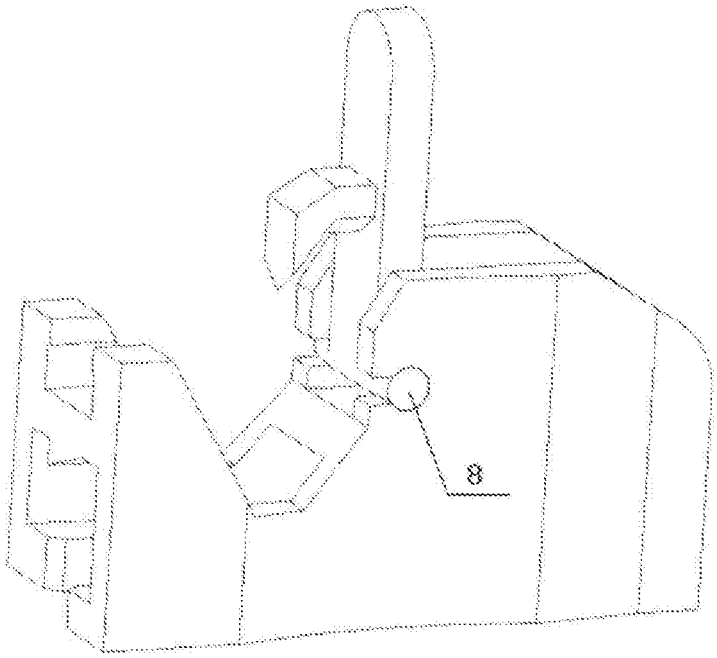
FIG. 6 is the diagram of the slider of the rotating shaft.
Figure 7:
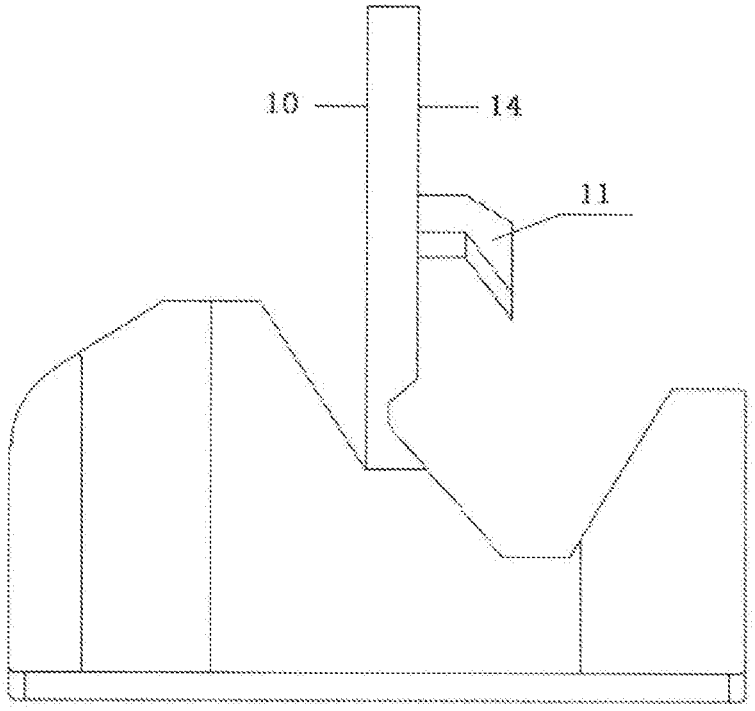
FIG. 7 is the main view of the slider with the bending structure.
Figure 8:
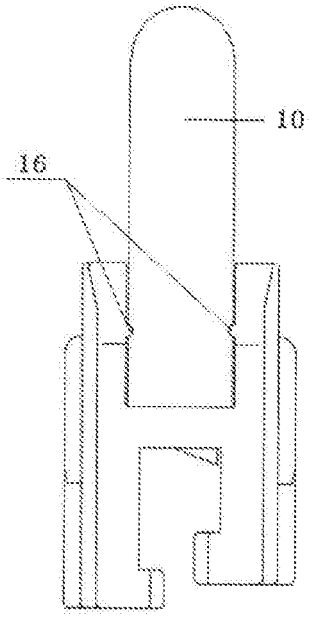
FIG. 8 is the left view of the slider with the bending structure.
Figure 9:
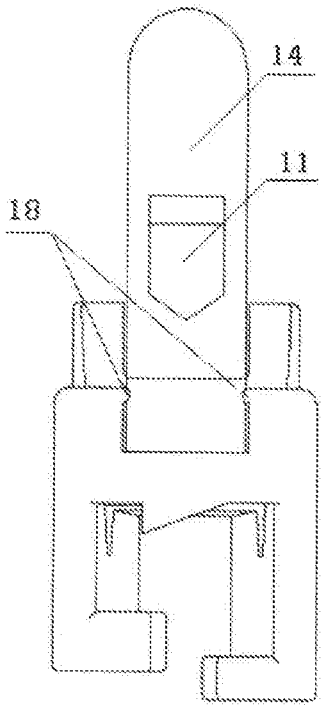
FIG. 9 is the right view of the slider with the bending structure.
Figure 10:
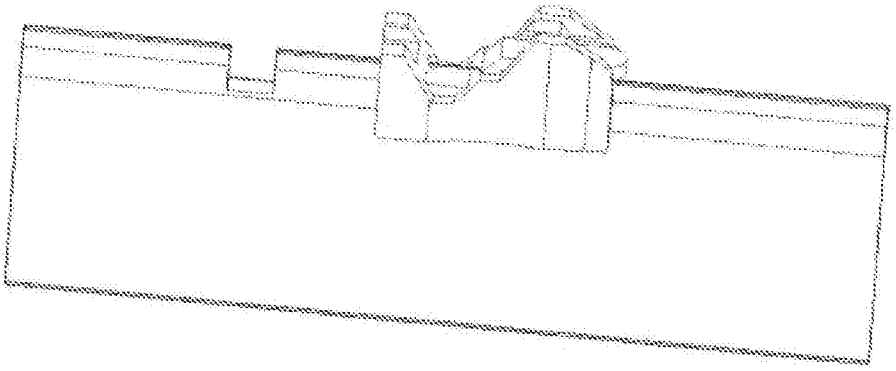
FIG. 10 is the diagram of the protective slider zipper in the protected state.
Figure 11:
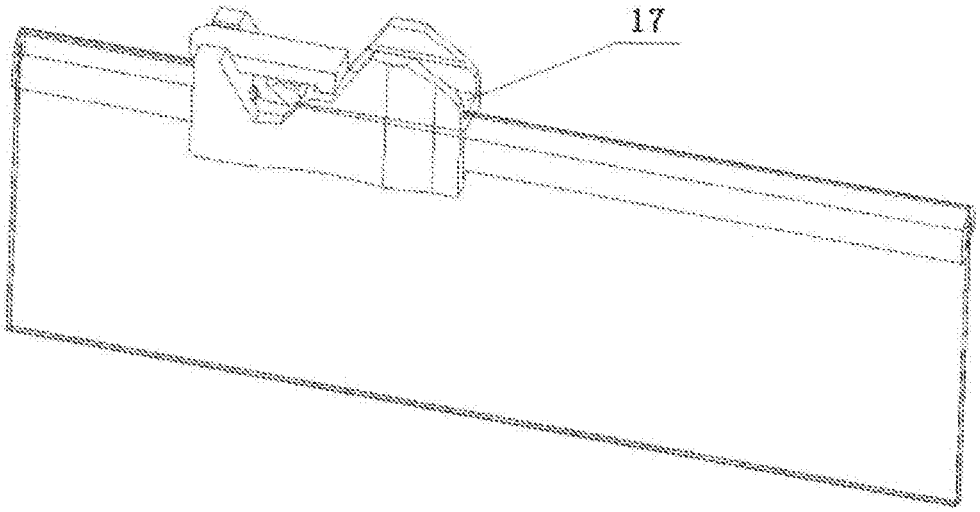
FIG. 11 is the diagram of the protective slider zipper in the working state.

What the numbers stand tor: a slider (1), a zipper (2), a female strip (4), a first side surface (5), a second side surface (6), a bending structure (7), a restating shaft (8), a second work support surface (9), a first protection support surface (10), a first slider hand (11), a second slider hand (12), a slider groove (13), a first work support surface (14), a reinforcing rib (15), a protection positioning step (16), a second protection support surface (17), a work positioning step (18), a protection structure (19) and ailerons (20).

DETAILED DESCRIPTION OF THE EMBODIMENTS

A protective slider zipper, which comprises a zipper (2) and a slider (1) for opening and closing the zipper (2), wherein the upper part of the slider (1) is in a protection structure (19); the root part of the protection structure (19) is in a bending structure (7) capable of being repeatedly bent; a first work support surface (14) at one side of the protection structure (19) is fixedly connected with a first slider hand (11); the zipper (2) comprises a female strip (3) and a male strip (4); and the female strip (3) is connected with and separated from the male strip (4) through the slider (1).

The protective slider zipper, which comprises the zipper (2) and the slider (1) for opening and closing the zipper (2), wherein the protection structure (19) is connected with the slider (1) through a rotating shaft (8); the first work support surface (14) at one side of the protection structure (19) is fixedly connected with the first slider hand (11); the zipper (2) comprises the female strip (3) and the male strip (4); and the female strip (3) is connected with and separated from the male strip (4) through the slider (1).

The female strip (3) is connected to a first side surface (5); and the male strip (4) is connected to a second side surface (6).

A second work support surface (9) and a work positioning step (18) for fixing the protection structure (19) are arranged at one end of the slider (1); a second slider hand (12) is arranged at the inner side of the lower part of the second work support surface (9); a second protection support surface (17) and a protection positioning step (16) for fixing the protection structure (19) are arranged at the other end of the slider (1); the protection structure (19) is pushed back and forth by hands; when a first protection support surface (10) at one side of the protection structure (19) contacts the second protection support surface (17) on the slide block, the protection positioning step (16) fixes the protection structure (19) on the second protection support surface (17), and prevents the protection structure (19) from loosening to play a positioning role, and the slider (1) is in a protected state; and when the first work support surface (14) at one side of the protection structure (19) contacts the second work support surface (9) on the slider (1), the work positioning step (18) fixes the protection structure (19) on the second work support surface (9), and prevents the protection structure (19) from loosening to play a positioning role, and the slider (1) is in a working state.

The second slider hand 12 penetrates into a first outline for clearing the residues in the male strip (4) when the zipper is closed from top to bottom in general.

An aileron (20) is arranged at the upper part of each of the female strip (3) and the male strip (4); and the two ailerons (20) are fastened to each other to prevent dust from entering when the zipper (2) is locked.

The protection structure (19) is connected with the slider (1) through the bending structure (7) or the rotating shaft (8).

A slider groove (13) is formed in one end of the zipper (2); the slider (1) moved to the slider groove (13); the protection structure (19) is pushed to the second work support surface (9); the slider (1) is in a working state; and the first slider hand (11) enters the slider groove (13) and is lightly pulled towards the other end of the zipper (2), so that the bag can be opened.

A reinforcing rib (15) is arranged at the open part of the zipper (2) to prevent other substances from entering when the zipper (2) is at the opening.

The top end of the protection structure (19) is higher than two ends of the slider (1) when fastened to the second work support surface (9) and the second protection support surface (17) on the slider (1).

The protective slider zipper meets the requirements of consumers on safety of children, and is simple and convenient to operate. The protective slider zipper can be easily opened by a simple action of 'wrenching, pressing and pulling'. The protective slider zipper is very easy to open for adults and old people, but is very challenging for children with the ages of five or below.

The protective slider zipper is applicable to the plastic packing bag which can be cyclically opened, and particularly is applicable to a slider zipper device which improves the opening-closing strip or the zipper applied to the plastic bag and can be prevented from being opened by children. The protective slider zipper can be ideally applied to packages of my products, including home nursing, chemical industry, medicines, healthcare products and other granules, powder and solid mixtures, as well as the products which children are prohibited to eat or touch in the absence of adult supervision. A flexible package with the protective slider zipper is also applicable to the packages of medicinal cannabis foods due to the facts that the medicinal cannabis foods need to be prevented from being touched by children, and meanwhile, the shelf life needs to be prolonged as much as possible.

The protective slider zipper can be easily opened by adults, but cannot be opened by children at random, meets the requirements on safety of children, simultaneously can prolong the shelf life and has relatively great economic value and the social value.

What is claimed is:

1. A protective slider zipper, comprising;

a zipper and a slider for opening and closing the zipper, wherein an upper part of the slider is a protection structure; the root part of the protection structure is in a bending structure capable of being repeatedly bent; a first work support surface at one side of the protection structure is fixedly connected with a first slider hand; the zipper comprises a female strip and a male strip;

the female strip is connected with and separated from the male strip through the slider;

a second work support surface and a work positioning step for fixing the protection structure are arranged at one end of the slider;

a second slider hand is arranged at an inner side of a lower part of the second work support surface; and a second protection support surface and a protection positioning step for fixing the protection structure are arranged at the other end of the slider.

2. A protective slider zipper, comprising a zipper and a slider for opening and closing the zipper, wherein a protection structure is connected with the slider through a rotating shaft; a first work support surface at one side of the protection structure is fixedly connected with a first slider hand; the zipper comprises a female strip and a male strip; and the female strip is connected with and separated from the male strip through the slider.

3. The protective slider zipper in claim 1, wherein the female strip is connected to a first side surface; and the male strip is connected to a second side surface.

4. The protective slider zipper in claim 2, wherein the female strip is connected to a first side surface; and the male strip is connected to a second side surface.

5. The protective slider zipper in claim 2, wherein a second work support surface and a work positioning step for fixing the protection structure are arranged at one end of the slider; a second slider hand is arranged at an inner side of a lower part of the second work support surface; and a second protection support surface and a protection positioning step for fixing the protection structure are arranged at the other end of the slider.

6. The protective slider zipper in claim 1, wherein an aileron is arranged at an upper part of each of the female strip and the male strip; and the two ailerons are fastened to each other when the zipper is locked.

7. The protective slider zipper in claim 2, wherein an aileron is arranged at an upper part of each of the female strip and the male strip; and the two ailerons are fastened to each other when the zipper is locked.

8. The protective slider zipper in claim 1, wherein a slider groove is formed in one end of the zipper.

9. The protective slider zipper in claim 2, wherein a slider groove is formed in one end of the zipper.

10. The protective slider zipper in claim 1, wherein a reinforcing rib is arranged at an. open part of the zipper.

11. The protective slider zipper in claim 2, wherein a reinforcing rib is arranged at an open part of the zipper.

12. The protective slider zipper in claim 1 wherein top end of the protection structure is higher than two ends of the slider when fastened to the second work support surface and the second protection support surface on the slider.

13. The protective slider zipper in claim 5, wherein a top end of the protection structure is higher than two ends of the slider when fastened to the second work support surface and the second protection support surface on the slider.

* * * * *